US007352977B2

(12) United States Patent
Nakano et al.

(10) Patent No.: US 7,352,977 B2
(45) Date of Patent: Apr. 1, 2008

(54) TONER LEVEL DETECTION METHOD AND IMAGE FORMING APPARATUS EMPLOYING SUCH TONER LEVEL DETECTION METHOD

(75) Inventors: Nobuhiko Nakano, Nara (JP); Masato Asanuma, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 312 days.

(21) Appl. No.: 11/107,173

(22) Filed: Apr. 15, 2005

(65) Prior Publication Data

US 2005/0238369 A1 Oct. 27, 2005

(30) Foreign Application Priority Data

Apr. 26, 2004 (JP) ..... 2004-129909

(51) Int. Cl.
*G03G 15/08* (2006.01)

(52) U.S. Cl. ..... 399/30; 399/62

(58) Field of Classification Search ..... 399/27, 399/30, 62, 63, 258; 118/689, 690
See application file for complete search history.

(56) References Cited

U.S. PATENT DOCUMENTS

| | | | | |
|---|---|---|---|---|
| 4,032,227 | A * | 6/1977 | Hubbard et al. | 399/30 |
| 5,150,135 | A * | 9/1992 | Casey et al. | 347/125 |
| 5,204,698 | A * | 4/1993 | LeSueur et al. | 347/140 |
| 5,787,320 | A * | 7/1998 | Eun et al. | 399/59 |
| 6,052,545 | A * | 4/2000 | Komiya et al. | 399/61 |
| 6,397,017 | B1 | 5/2002 | Sakai et al. | |
| 6,501,916 | B2 * | 12/2002 | Suzuki | 399/30 |
| 6,556,795 | B2 * | 4/2003 | Miyamura et al. | 399/30 |
| 6,640,060 | B2 * | 10/2003 | Yamaguchi et al. | 399/27 |
| 6,687,467 | B2 * | 2/2004 | Katoh | 399/30 |

FOREIGN PATENT DOCUMENTS

| | | |
|---|---|---|
| JP | 02-280176 | 11/1990 |
| JP | 08-114975 | 5/1996 |
| JP | 08-339118 | 12/1996 |
| JP | 09-197797 | 7/1997 |
| JP | 10-207213 | 8/1998 |
| JP | 10-240084 | 9/1998 |
| JP | 2000-137377 | 5/2000 |
| JP | 2000-338763 | 12/2000 |
| JP | 2000-338767 | 12/2000 |
| JP | 2000-352865 | 12/2000 |
| JP | 2001-51489 | 1/2001 |
| JP | 2002-148925 | 5/2002 |
| JP | 2002-372847 | 12/2002 |
| JP | 2004-101923 | 4/2004 |

* cited by examiner

*Primary Examiner*—Robert Beatty
(74) *Attorney, Agent, or Firm*—Renner, Otto, Boisselle & Sklar, LLP

(57) ABSTRACT

Forced supply of toner(s) from toner hopper(s) to developer storage container(s) is executed while interrupting and/or prohibiting image forming operation(s) so as to prevent consumption of toner(s), toner level(s) within toner hopper(s) being determined to be low and low toner level condition(s) being reported to user(s) when temporal change(s) in value(s) detected by toner sensor(s) is/are small.

17 Claims, 5 Drawing Sheets

TONER LEVEL DETECTION METHOD AND IMAGE FORMING APPARATUS EMPLOYING SUCH TONER LEVEL DETECTION METHOD

BACKGROUND OF INVENTION

This application claims priority to Patent Application No. 2004-129909 filed in Japan on 26 Apr. 2004, the content of which is hereby incorporated herein by reference in its entirety.

The present invention pertains to a copier, optical printer, facsimile machine, or other such image forming apparatus making use of electrophotography, and to a method for detecting toner level in the context of such an image forming apparatus. In particular, the present invention pertains to an improvement for detecting, with high precision, when toner level has become low (hereinafter referred to as "low toner level").

Conventionally, in a typical electrophotographic image forming apparatus, toner might be delivered from a toner hopper storing toner to a developer storage container, and toner within such a developer storage container might be transported onto a photosensitive drum for formation of prescribed toner images.

Furthermore, with respect to the timing with which toner is delivered from this toner hopper to the developer storage container, taking for example the case of an image forming apparatus employing two-component developer comprising toner and carrier, a toner sensor comprising a magnetic permeability sensor might be disposed within the developer storage container, it being determined that the amount of toner within the developer storage container is insufficient and toner being supplied from the toner hopper to the developer storage container when the magnetic permeability detected by this toner sensor is greater than or equal to a prescribed value (i.e., magnetic permeability increases as the amount of toner decreases). This makes it possible to maintain more or less constant concentration of toner within the developer storage container.

Moreover, in the event that a state in which concentration of toner is low (i.e., a state in which magnetic permeability is greater than or equal to a prescribed value) persists for a prescribed time or longer despite having carried out supply of toner pursuant to the aforementioned control, it being determined that there is no longer any toner within the toner hopper, a depleted toner condition might be declared and the user might be prompted to replace the toner hopper or fill same with toner.

However, where this method is employed, because reporting of the depleted toner condition occurs in abrupt fashion, a situation might occur in which the apparatus cannot be used during the time while the user is getting a replacement toner hopper ready. In particular, when no toner hopper is readily available to the user, it is possible for a situation to occur in which the apparatus cannot be used for a long period of time.

Japanese Patent Application Publication Kokai No. H2-280176 (1990) (hereinafter "Patent Reference No. 1"), Japanese Patent Application Publication Kokai No. H9-197797 (1997) (hereinafter "Patent Reference No. 2"), Japanese Patent Application Publication Kokai No. 2000-338767 (hereinafter "Patent Reference No. 3"), and Japanese Patent Application Publication Kokai No. H10-207213 (1998) (hereinafter "Patent Reference No. 4") have therefore proposed detecting when the amount of toner is low in the form of a low toner level condition at a stage prior to when there would be no more toner within the toner hopper, this being reported to the user so as to give the user additional time to have a toner hopper ready before occurrence of a depleted toner condition.

Patent Reference No. 1 discloses a method combining use of a sensor detecting optical density and a sensor detecting magnetic permeability of developer. This is such that toner concentration within developer is controlled so as to be constant by means of magnetic permeability detection while optical density of a specified pattern on the photosensitive body is at the same time detected to maintain final image density, accurate detection of low toner level and depleted toner conditions as well as display of warnings with respect thereto being carried out based on the two sensors.

For proper supply of toner that is neither too much nor too little in light of changes in fractional image area as well as variation in ability to supply toner across different apparatuses due to variation in ability to deliver toner, Patent Reference No. 2 proposes adjustment of supply amount in correspondence to a maximum supply ratio; i.e., by means of a ratio between toner supply member drive time existing upon obtaining an image density at a photosensitive body detected by a photosensor and toner supply member drive time existing when supplying a maximum amount of toner.

Patent Reference No. 3 discloses a method in which a low toner level condition is declared in the event that a toner supply drive member is driven for a prescribed time or longer.

Patent Reference No. 4 discloses carrying out determination of existence of a low toner level condition based on relative number of toner supply iterations and/or detection of decrease in toner concentration.

At the aforementioned Patent Reference No. 1, the fact that a plurality of sensors are employed makes for complicated structure and/or increased cost. And what is more, to the extent that a plurality of sensors are provided it will also be true that there will be an increased number of factors contributing to detection of false positives, making it difficult to adequately ensure reliable detection of the low toner level condition.

Because they make it possible to report a low toner level condition by means of an inexpensive and simple structure, Patent Reference Nos. 2 through 4 permit elimination of the problems at Patent Reference No. 1. However, because Patent Reference No. 2 is such that the low toner level condition is detected based on image density at the photosensitive body, it is impossible to carry out detection in a manner such as would exclude other factors (factors other than toner level) causing changes in image density at the photosensitive body. That is, as it will not be possible to detect toner level with high precision when image density at the photosensitive body changes due to the influence of photosensitive body deterioration, temperature, or humidity, it will be difficult with the method of this Patent Reference No. 2 to adequately ensure reliable detection of the low toner level condition.

Furthermore, with the method of Patent Reference No. 3, because variation in amount supplied per unit time by respective toner supply drive members is not small, existence of this variation in ability to deliver toner produces error in detection of depleted toner and low toner level conditions. As a result, it is possible for a problematic situation to occur in which a hopper replacement request is reported despite the fact that a sufficient amount of toner remains within the hopper; and conversely, it is possible for a problematic situation to occur in which a hopper replacement request is not reported despite the fact that image formation is jeopardized due to absence of toner.

Moreover, with the method of Patent Reference No. 4, not only does variation in ability to deliver toner constitute a factor contributing to error as was the case above, but the magnitude of print coverage can also be responsible for an additional cause of error, it being possible that a low toner level condition will be mistakenly reported during execution of printing operations when print coverage is high.

SUMMARY OF INVENTION

The present invention was conceived in light of the foregoing problems, it being an object thereof to provide an image forming apparatus and a method for detecting toner level in which low toner level condition(s) is/are detected in inexpensive and simple fashion, properly and without faulty operation, while excluding factors arising in connection with print coverage, ability to deliver toner, and/or the like which might otherwise contribute to error.

Overview Of Invention

As a result of intensive study undertaken in light of the foregoing problems by the inventors of the present invention, forced toner supply mode(s), not accompanying consumption of toner, is/are executed to properly ascertain low toner level condition(s), temporal change(s) in value(s) detected by toner detection means being used to ascertain low toner level condition(s). That is, in the event that toner level(s) within toner hopper(s) (toner supply means) become low, because there will be a decrease in amount(s) of toner(s) delivered per unit time to developer storage container(s), absolute value(s) of temporal change(s) in value(s) detected by toner detection means will be reduced. The inventors of the present invention arrived at the present invention upon discovering that it is possible to utilize this fact to detect low toner level condition(s). As the foregoing toner detection means, device(s) detecting toner concentration(s) may be employed for two-component developer(s), and device(s) detecting toner amount(s) may be employed for one-component developer(s).

More specifically, one or more embodiments of the present invention may be predicated upon a method for detecting one or more toner levels of one or more toner supply means in the context of at least one image forming apparatus constituted so as to permit supply of toner from at least one of the toner supply means to one or more developer storage containers and constituted so as to execute one or more operations in which toner is supplied from at least one of the toner supply means to at least one of the developer storage container or containers when at least one amount of at least one toner within at least one of the developer storage container or containers detected by one or more toner detection means is less than or equal to at least one prescribed amount. This toner level detection method may comprise executing at least one of the operation or operations in which toner is supplied from at least one of the toner supply means to at least one of the developer storage container or containers while at least one image forming operation is interrupted and/or prohibited; and in the event that, during execution of at least one of the operation or operations, at least one absolute value of at least one amount of change per unit time in at least one of the amount or amounts of at least one of the toner or toners within at least one of the developer storage container or containers detected by at least one of the toner detection means is less than or equal to at least one prescribed low toner level sense value, detecting existence of at least one low toner level condition indicating that at least one of the toner level or levels of at least one of the toner supply means is low, and reporting at least one low toner level condition to at least one user.

Below, a result of such specific features will be described. In the event that toner supply (supply of toner from toner supply means to developer storage container(s)) cannot keep up with toner consumption, e.g., during image forming operation(s) when print coverage is high, it may no longer be possible to maintain prescribed amount(s) of toner(s) within developer storage container(s). Upon occurrence of such a condition, image forming operation(s) might be interrupted, toner might be delivered in forced fashion from toner supply means to developer storage container(s), and image forming operation(s) might be resumed when amount(s) of toner(s) within developer storage container(s) reach prescribed amount(s). During such forced delivery of toner(s) when image forming operation(s) is/are interrupted, output(s) of detection from toner detection means change in correspondence to toner level(s) at toner supply means. If toner level(s) at toner supply means is/are adequate and amount(s) of toner(s) delivered per unit time is/are adequate, change(s) in output(s) of detection from toner detection means will be pronounced. In contrast, in the event that toner level(s) at toner supply means is/are low and amount(s) of toner(s) delivered per unit time is/are extremely small, change(s) in output(s) of detection from toner detection means will be small (less than or equal to prescribed low toner level sense value(s)). Thus, amount(s) of change per unit time in output(s) from toner detection means changes in correspondence to toner level(s) at toner supply means. This being the case, in the event that absolute value(s) of such amount(s) of change in output(s) is/are less than or equal to prescribed value(s) (low toner level sense value(s)), it being determined that only small amount(s) of toner(s) remain at toner supply means, low toner level condition(s) is/are determined to exist and is/are reported to user(s). Moreover, with respect to the timing with which the aforementioned operation(s) in which toner(s) is/are delivered in forced fashion from toner supply means to developer storage container(s) is/are executed, this is not limited to occurring during the aforementioned image formation operation(s) but may occur at time(s) when image formation is requested. In such case, operation(s) in which toner(s) is/are delivered from toner supply means to developer storage container(s) might be executed while image forming operation(s) is/are prohibited, toner level detection operation(s) being in other respects carried out in the same fashion as described above.

Two more strategies for improving reliability of the aforementioned toner level detection operation(s) will next be described.

First, notwithstanding reporting of low toner level condition(s) in correspondence to amount(s) of change in output(s) from toner detection means, and/or even where low toner level condition(s) is/are not determined to exist because amount(s) of change is/are large, it is impossible to rule out the possibility that a situation could exist in which it is not possible to achieve prescribed amount(s) of toner(s) within developer storage container(s). Therefore, in the event that prescribed amount(s) of toner(s) is/are not detected despite supply of toner(s) while toner(s) is/are not being consumed by image formation, low toner level condition(s) might be reported regardless of amount(s) of change in output(s) from toner detection means. That is, in the event that, when executing at least one of the operation or operations in which toner is supplied from at least one of the toner supply means to at least one of the developer storage container or containers while at least one of the image forming operation or operations is interrupted and/or prohibited, at least one of the amount or amounts of at least one of the toner or toners within at least one of the developer storage container or containers detected by at least one of the toner detection means fails to reach at least one prescribed amount despite execution of at least one of the toner supply operation or operations, at least one low toner level condition might be determined to exist and at least one low toner level condition might be reported to at least one of the user or users regardless of at least one of the amount or amounts of change per unit time in at least one of the amount or amounts of at least one of the toner or toners within at least one of the developer storage container or containers.

With respect to the other, even where it has been ascertained that a state in which low toner level condition(s) should be reported exists, in the event that it is impossible to execute prescribed supply of toner(s) due, for example, to trouble at toner supply means and/or image formation apparatus(es), it is conceivable that amount(s) of change in output(s) from toner detection means could become small despite inability to deliver toner(s) and/or reduction in ability to deliver toner(s) notwithstanding the fact that there is sufficient amount(s) of toner(s) remaining at toner supply means. Considering the possibility of such abnormal event(s), use might be made of cumulative time(s) during which toner supply operation(s) is/are executed that might be stored at storage means; and in the event that situation(s) which would otherwise result in reporting of low toner level condition(s) arise during cumulative execution time(s) that is/are shorter than prescribed time(s) (time period(s) during which it is impossible for low toner level condition(s) to occur; before the low toner level sense time(s) is/are reached), error display might be carried out and this fact might be reported to user(s). That is, such method might further comprise storing at least one cumulative time during which at least one of the operation or operations in which toner is supplied from at least one of the toner supply means to at least one of the developer storage container or containers is executed; and in the event that, before at least one of the stored cumulative toner supply operation execution time or times reaches at least one prescribed low toner level sense time which is at least one time during which at least one low toner level condition can occur, at least one absolute value of at least one amount of change per unit time in at least one of the amount or amounts of at least one of the toner or toners within at least one of the developer storage container or containers detected by at least one of the toner detection means is less than or equal to at least one prescribed low toner level sense value, not carrying out low toner level condition reporting but reporting the fact that toner delivery is abnormal to at least one of the user or users.

Low toner level condition declaration and/or reporting may be carried out in correspondence to amount(s) of change in output(s) from toner detection means while implementing either or both of the two strategies as described above.

Furthermore, the following may be presented as an example of an operation for detecting depleted toner condition(s) indicating that there is no more toner within toner supply means such as might be carried out following detection of low toner level condition(s) pursuant to any of the aforementioned respective solution means. That is, in the event that, following detection of existence of at least one low toner level condition, it is detected by at least one of the toner detection means that at least one of the amount or amounts of at least one of the toner or toners within at least one of the developer storage container or containers is less than or equal to at least one prescribed depleted toner sense amount, existence of at least one depleted toner condition indicating that there is no more toner within at least one of the toner supply means might be detected, and at least one depleted toner condition might be reported to at least one of the user or users.

Furthermore, the following may be presented as specific examples of developer and toner detection means corresponding thereto. At least one two-component developer comprising at least one toner and at least one carrier may be stored within at least one of the developer storage container or containers; and at least one of the toner detection means may detect at least one concentration of at least one of the toner or toners within at least one of the developer storage container or containers.

In such case, magnetic permeability sensor(s), optical sensor(s), and/or other such sensor(s) provided near develop roller(s) and/or the like may be employed as toner detection means. Particularly preferred in the present invention is/are magnetic permeability sensor(s), use of differential-transformer-type toner concentration sensor(s) being preferred. Where such toner concentration sensor(s) is/are used, detected change refers to change(s) in voltage(s) output from toner concentration sensor(s).

Also within the purview of the technical idea of the present invention is/are image forming apparatus(es) carrying out detection of toner level(s) through use of toner level detection method(s) in accordance with any one of the aforementioned respective solution means. Such an image forming apparatus might comprise at least one forced supply execution means executing one or more operations in which toner is supplied from at least one of the toner supply means to at least one of the developer storage container or containers while at least one image forming operation is interrupted and/or prohibited; at least one toner detection means detecting at least one amount of change per unit time in at least one amount of at least one toner within at least one of the developer storage container or containers during execution of at least one of the toner supply operation or operations by at least one of the forced supply execution means; and at least one report means that, in the event that at least one absolute value of at least one of the amount or amounts of change per unit time in at least one of the amount or amounts of at least one of the toner or toners within at least one of the developer storage container or containers detected by at least one of the toner detection means is less than or equal to at least one prescribed low toner level sense value, detects existence of at least one low toner level condition indicating that at least one of the toner level or levels of at least one of the toner supply means is low, and reports at least one low toner level condition to at least one user.

Thus, method(s) and apparatus(es) in accordance with the present invention are such that toner(s) is/are supplied from toner supply means to developer storage container(s) while image forming operation(s) is/are interrupted and/or prohibited, it being determined that toner level(s) at toner supply means is/are low in the event that absolute value(s) of amount(s) of change per unit time in amount(s) of toner(s) within developer storage container(s) is/are less than or equal to prescribed value(s). This being the case, it is possible for low toner level condition(s) to be reported to user(s) in inexpensive and simple fashion, but also properly and without faulty operation, while excluding factors related to print coverage and/or ability to deliver toner which might otherwise contribute to error.

DESCRIPTION OF PREFERRED EMBODIMENTS

Below, embodiments of the present invention are described with reference to the drawings. Through the vehicle of the present embodiment, application of the present invention to an image forming apparatus employing two-component developer comprising toner and carrier is described. Furthermore, the present embodiment will be described in terms of a situation in which the amount of toner within a developer storage container is detected based on the value of the voltage output by a toner sensor.

Schematic Constitution of Image Forming Unit

Figure 1:
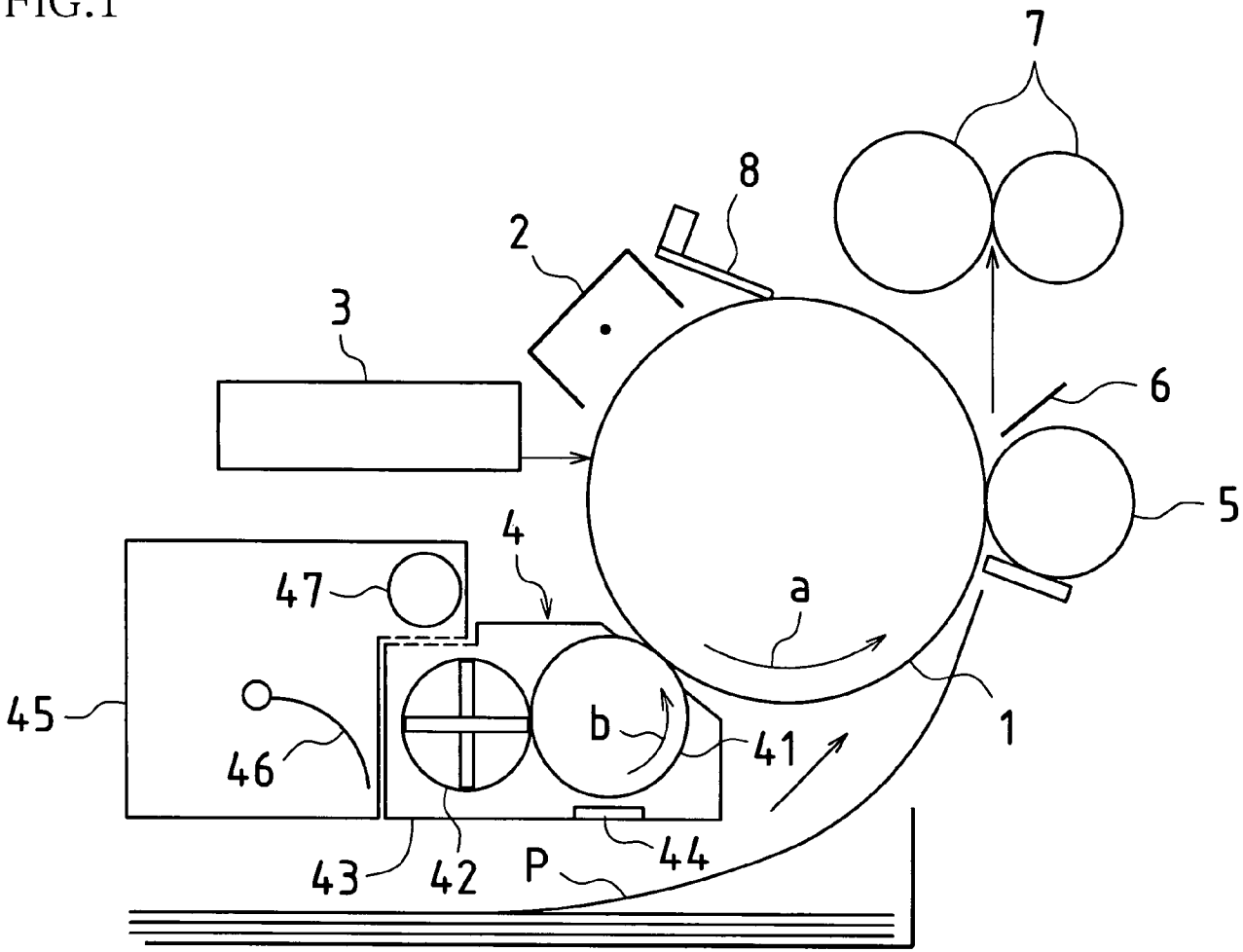
FIG. 1 is a drawing showing in schematic fashion the constitution of an image forming unit incorporated within an image forming apparatus associated with an embodiment of the present invention.
Figure 2:
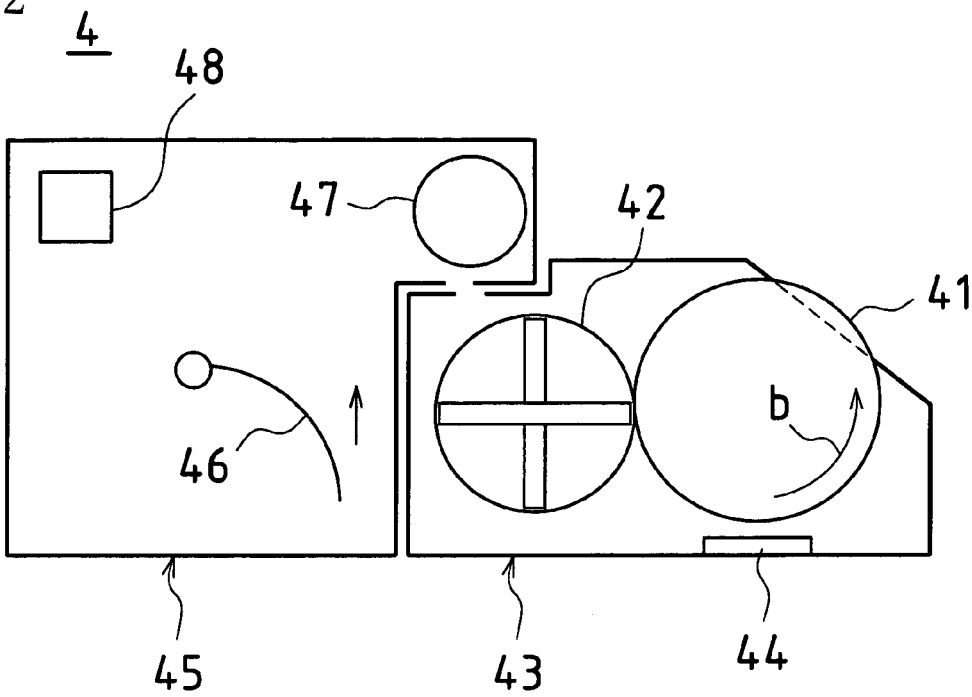
FIG. 2 is a drawing showing in schematic fashion the constitution at the interior of a developer storage container and a toner hopper provided at the image forming unit shown in FIG. 1.

FIG. 1 is a drawing showing in schematic fashion the constitution of an image forming unit incorporated within an image forming apparatus associated with the present embodiment; FIG. 2 is a drawing showing in schematic fashion the constitution at the interior of developer storage container 43 and toner hopper 45, which serves as toner supply means, these being provided at this image forming unit. Moreover, the image forming unit of the present embodiment may be used as image forming component at digital copier(s), image forming component at facsimile machine(s) and/or word processor(s), and/or computer output device(s).

As shown in FIGS. 1 and 2, the image forming unit associated with the present embodiment is equipped with toner sensor 44 serving as toner detection means; developer storage container 43 containing therein two-component developer; and toner hopper 45 capable of delivering toner to developer storage container 43 in forced fashion by means of toner delivery members 46, 47.

Moreover, the aforementioned image forming unit is equipped with an image forming subassembly that forms images; a paper supply apparatus that delivers recording paper P to this image forming subassembly; and fuser rollers 7 serving as fusing means.

The image forming subassembly is equipped with image carrier (hereinafter "photosensitive drum") 1 at which a photosensitive layer is arranged on an aluminum tube; and, arranged in order about this photosensitive drum 1, is equipped with: charging means 2; exposing means (hereinafter "laser unit") 3; develop means 4 comprising developer storage container 43 and toner hopper 45; transfer means 5; separation means 6; and cleaning means 8.

Photosensitive drum 1 is, for example, a drum-like body of diameter approximately 30 mm which is disposed so as to permit rotation in the direction indicated by arrow a in the drawing. The surface of photosensitive drum 1 is uniformly charged to prescribed charge by a corona-type charger and/or a contacting-roller-type charging unit constituting charging means 2. Furthermore, formation of a prescribed latent electrostatic image potential thereon by laser unit 3 causes a latent electrostatic image to be carried by the surface of photosensitive drum 1. This photosensitive drum 1 typically comprises an electrically conductive base made of metal or resin; an undercoat layer formed over the surface thereof; and a photosensitive layer formed over the surface thereof. The photosensitive layer comprises a relatively thin carrier generation layer (CGL) formed over the undercoat layer; and a carrier transport layer (CTL) which is formed as the outermost layer and which has polycarbonate or the like as its main component. Exposure causes carrier to be generated at the CGL, movement of said carrier throughout the CTL causing cancellation of the charge produced by charging of the surface of photosensitive drum 1 so as to form the aforementioned latent electrostatic image potential.

Rotation of photosensitive drum 1 causes the latent electrostatic image carried by photosensitive drum 1 to be transported to a develop region where it is brought into contact with developer adhering to developer carrier (hereinafter "develop roller") 41 of develop means 4. Develop roller 41 rotates in the direction indicated by arrow b and presses against photosensitive drum 1. Note, however, that the direction of rotation of develop roller 41 is not limited hereto. In addition, toner within the developer carried by develop roller 41 is made to move and adhere in accordance with the latent electrostatic image on photosensitive drum 1, causing the latent electrostatic image to be made manifest and to be developed. A prescribed bias voltage is applied to develop roller 41 from a power supply, not shown, which is connected thereto.

Following develop, toner adhering to photosensitive drum 1 is transported to a prescribed transfer region. Recording paper P is fed to the transfer region by the aforementioned paper supply apparatus and is brought into contact with the toner image on photosensitive drum 1 in synchronous fashion. Transfer means 5, which is provided at the transfer region and which may be a contacting-roller-type device and/or a charger-type device (a contacting-roller-type device being shown in FIG. 1) equipped with a high-voltage power supply, applies a voltage to photosensitive drum 1 of polarity such as will cause transfer of toner. This causes toner to move to recording paper P, transferring the toner image thereto. Recording paper P is separated from photosensitive drum 1 and/or transfer means 5 by separation means 6, the toner on said recording paper P being thereafter fixed thereto, e.g., through hot-melt action, pressure, and/or the like, by fuser rollers 7. In addition, recording paper P is discharged to the exterior of the apparatus. Furthermore, following transfer, the surface of photosensitive drum 1 is cleaned by cleaning means 8.

As shown in FIG. 2, develop means 4 is equipped with developer storage container 43; and toner hopper 45, which is removably installed at this developer storage container 43 and which stores toner therewithin.

Housed within developer storage container 43 there are: the aforementioned develop roller 41 which functions as a magnetic brush to deliver toner toward photosensitive drum 1; agitator paddle 42 which agitates toner and carrier; and toner sensor 44 which detects toner concentration. Furthermore, developer storage container 43 is equipped with a doctor blade or the like, not shown, that defines the thickness of the developer layer adhering to develop roller 41. Moreover, formed at developer storage container 43 there is an opening for allowing develop roller 41 to come in contact with photosensitive drum 1.

Develop roller 41 is equipped with a stationary magnetic body which is referred to as a "magnetic roller" and which is disposed so as to be nonrotating with respect to developer storage container 43, and is equipped with a develop sleeve which is fitted onto the outside of this stationary magnetic body so as to permit rotation in a prescribed direction; the stationary magnetic body has a plurality of magnetic poles for delivering developer to photosensitive drum 1. This plurality of magnetic poles respectively cause developer to adhere to and be transported by the sleeve surface, and function, at the portion thereof which approaches photosensitive drum 1, as a magnetic brush causing developer to form chain-like clusters. In particular, a magnetic pole arranged opposite photosensitive drum 1 and referred to as the develop main pole has an important role to play during develop.

Nonmagnetic metal may be used as material for the develop sleeve at develop roller 41, the surface thereof being formed so as to have appropriate roughness for toner retention and transport as well as for satisfactorily imparting triboelectric charge thereto; and for satisfactory achievement of develop, a develop bias voltage should be applied to the develop sleeve during develop.

As this develop bias voltage, AC voltage(s), DC voltage(s), and/or superposed AC and DC voltages may be employed. For this reason, a metallic material having electrical conductivity is used as material for the develop sleeve.

Moreover, substances which may be used as developer include one-component magnetic developer comprising magnetic toner, one-component nonmagnetic developer comprising nonmagnetic toner, and two-component developer comprising nonmagnetic toner and magnetic carrier; and the material selected for the develop sleeve should be selected in correspondence to the developer used. Description of the present embodiment is carried out in terms of a situation in which the aforementioned two-component developer is used.

The magnetic carrier making up this two-component developer is powdered iron, powdered ferrite, powdered nickel, or the like, or any of these having organic polymer coating the surface thereof; furthermore, the toner particles are resin throughout which colorant pigment(s), dye(s), and/or other such additive(s) have been dispersed.

Description of Toner Sensor

The foregoing toner sensor 44 will next be described in detail.

The foregoing develop means 4 employs two-component-type developer, the developer being agitated and friction causing the toner to become charged, and this charged toner is made to electrostatically adhere to the latent electrostatic image formed on photosensitive drum 1, forming a visible image. With this type of develop means 4, a magnetic permeability sensor is employed as toner sensor 44 for measuring toner concentration; and in particular, in the present embodiment, a differential-transformer-type toner sensor 44 is employed. Detailed description follows.

Figure 3:
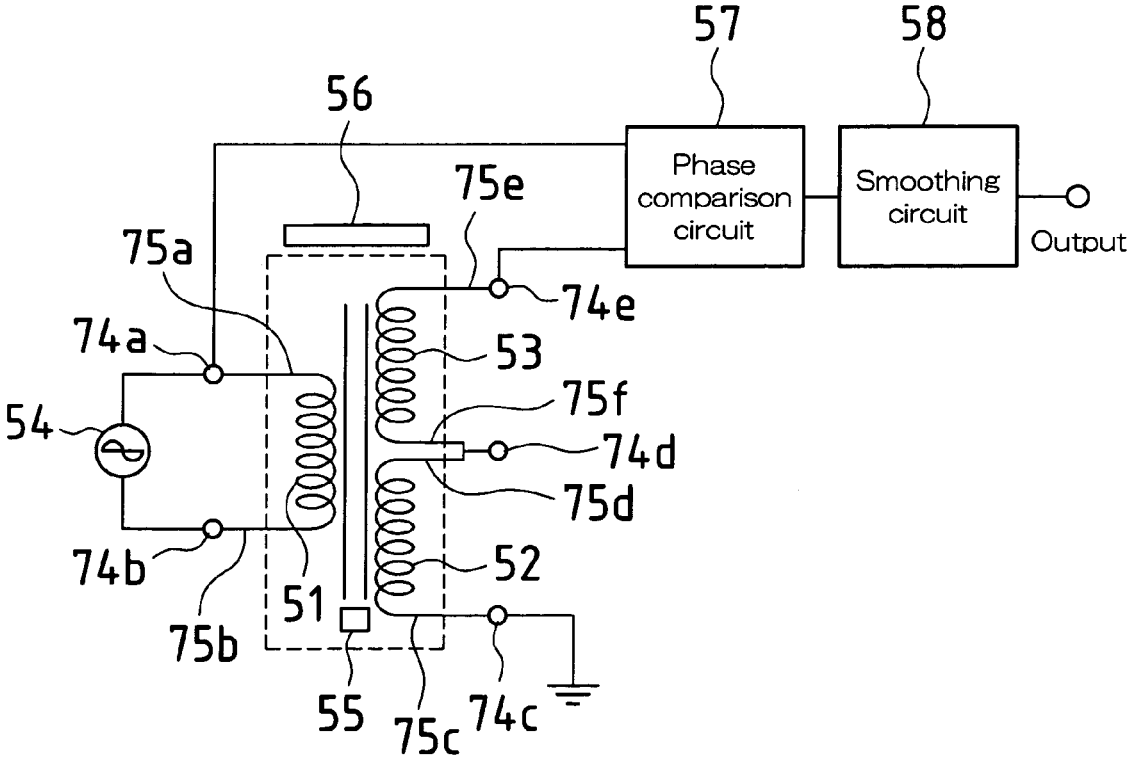
FIG. 3 is a schematic diagram showing circuit structure at a differential-transformer-type toner sensor employed in the present embodiment.

FIG. 3 is a schematic diagram showing circuit structure at differential-transformer-type toner sensor 44. Toner sensor 44 comprises primary coil 51; reference coil 52; detection coil 53; AC power supply 54; threaded core 55; developer 56; phase comparison circuit 57; smoothing circuit 58; five I/O terminals 74*a*, 74*b*, 74*c*, 74*d*, 74*e*; and six lead wires 75*a*, 75*b*, 75*c*, 75*d*, 75*e*, 75*f*. AC voltage is supplied from AC power supply 54 to differential-transformer-type toner sensor 44 primary coil 51. At the secondary side thereof, two coils are wound in series so as to have approximately the same number of turns but so as to be of opposite polarity; one of these coils being reference coil 52, and the other of these coils being detection coil 53.

Threaded core 55 having high magnetic permeability is inserted therein near primary coil 51 and reference coil 52 so as to act as magnetic core, adjustment of the location of threaded core 55 permitting adjustment of inductance between primary coil 51 and reference coil 52. When developer or magnetic material (carrier) to be measured flows near primary coil 51 and detection coil 53, that developer or magnetic material (carrier) acts as magnetic core, causing a change in inductance between primary coil 51 and detection coil 53. Because the magnitude of this inductance is determined by the amount of magnetic particulate in the form of developer or magnetic toner which acts as magnetic core, it is possible to measure the amount of magnetic particulate, i.e., carrier concentration, based on the voltage output by detection coil 53.

Because reference coil 52 and detection coil 53 which are connected in series have approximately the same number of turns but are of opposite polarity, the difference between the two coils can be extracted as an output therefrom. The AC voltage delivered to primary coil 51 and the output from reference coil 52 and detection coil 53, these being secondary coils, are XOR-ed at phase comparison circuit 57, following which the signal output therefrom is made smooth at smoothing circuit 58 to produce a DC voltage so as to permit measurement of toner concentration.

Figure 4:
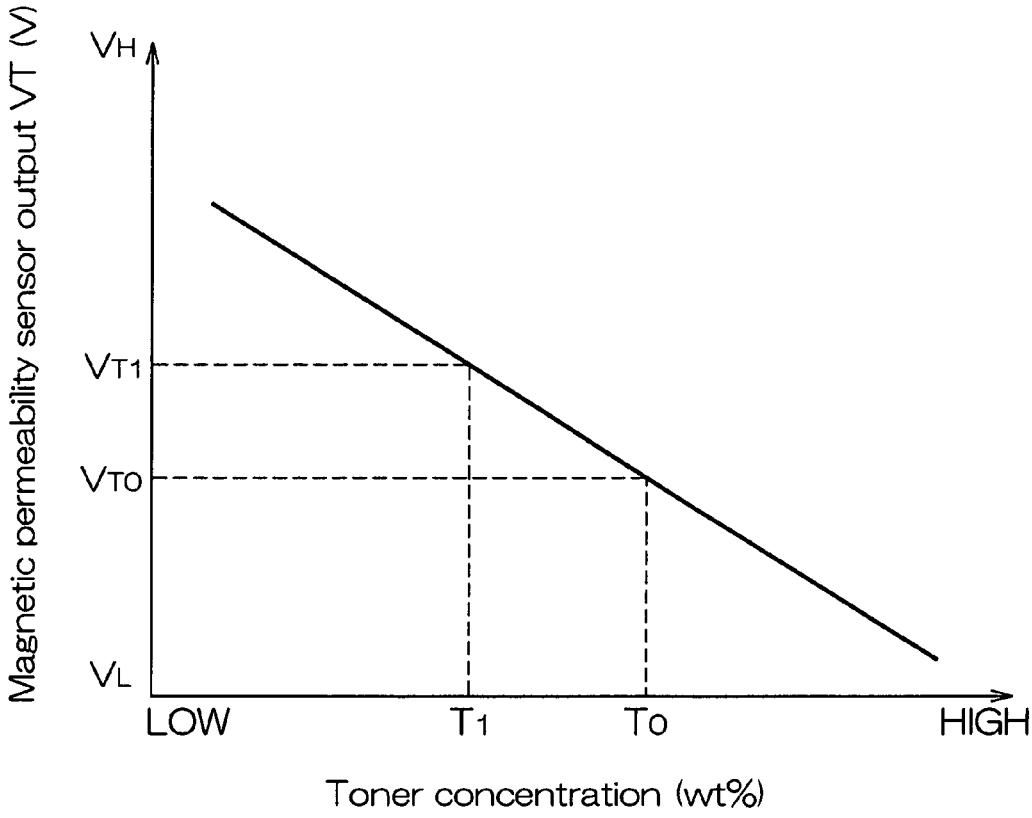
FIG. 4 is a drawing showing relationship between toner concentration within a developer storage container and voltage output by a magnetic permeability sensor in the present embodiment.

Toner sensor (magnetic permeability sensor) 44, which uses the foregoing method to carry out measurement of toner concentration, utilizes magnetic permeability to detect concentration of magnetic carrier, i.e., magnetic material. Accordingly, as shown in FIG. 4, output VT from toner sensor 44 is large when toner concentration is low, and output VT from toner sensor 44 is small when toner concentration is high. That is, referring to FIG. 4, when toner concentration decreases from T0 to T1, the corresponding values respectively output by the magnetic permeability sensor will increase from VT0 to VT1.

Figure 5:
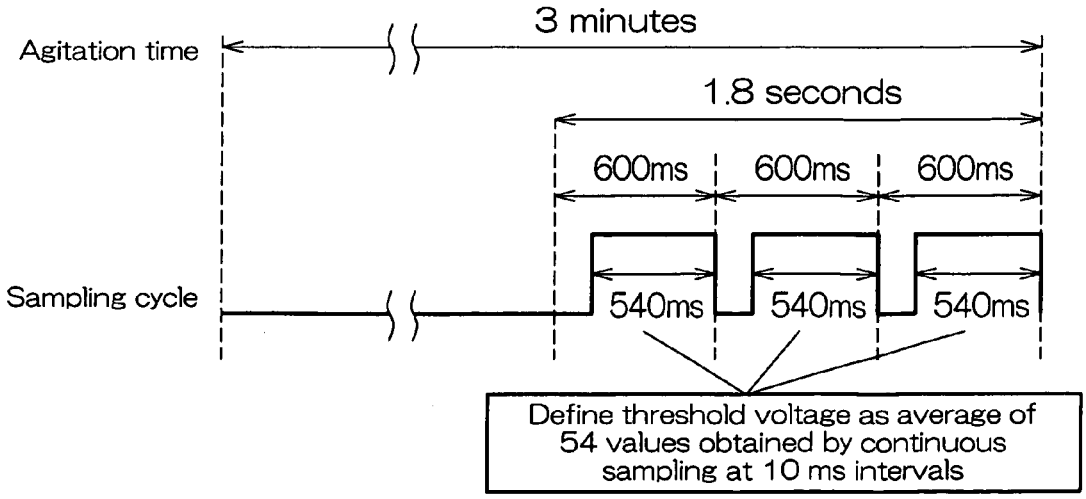
FIG. 5 is a timing chart to assist in explaining operations for determining threshold voltage(s) for develop means in the present embodiment.

For example, in the present embodiment, toner sensor 44 might be supplied with a voltage of 24 V, and might output between 0 V and 5 V based on the concentration of toner present within developer; output decreasing when toner concentration is high, and output increasing when toner concentration is low. Initially adjusted developer (unused), toner concentration of which is adjusted to 6.0% using such toner sensor 44, is first placed in developer storage container 43; and as shown in FIG. 5, this is agitated for 180 seconds (3 minutes), the average value of the output from toner sensor 44 as obtained by sampling during the final 1.8 seconds being determined to be what is referred to as the threshold voltage. Whether or not supply of toner from toner hopper 45 is to be executed is determined based on such threshold voltage. That is, in the event that the voltage output from toner sensor 44 is higher than the threshold voltage, it being determined that the amount of toner within developer storage container 43 is insufficient, supply of toner from toner hopper 45 is carried out.

Explaining this in more detail, during driving of develop roller 41 when the power supply is turned on and image forming operations are being carried out following determination of the aforementioned threshold voltage, the value output by toner sensor 44 is detected every 600 ms; and if the value output thereby is higher than the threshold voltage, then, during the next 600 ms, toner delivery members 46 and 47, which are driven by toner supply drive member(s), not shown, cause toner to be supplied from toner hopper 45 to developer storage container 43, where it is agitated by agitator paddle 42, develop roller 41 causing developer whose toner concentration is always ensured to be constant to be transported to photosensitive drum 1, where it is used to carry out develop.

Figure 6:
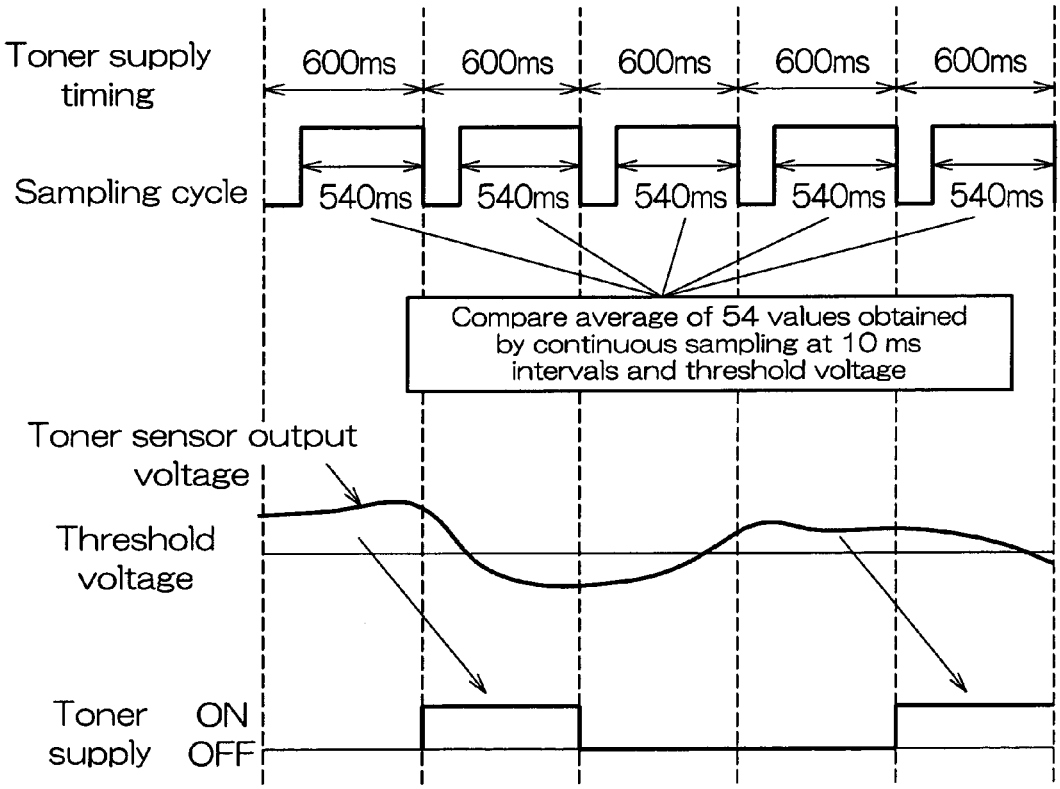
FIG. 6 is a timing chart to assist in explaining toner supply operations carried out based on voltage(s) output by toner sensor(s) in the present embodiment.

Explaining this in still further detail, as shown in FIG. 6, the average value of the output from the toner sensor during the lattermost 540 ms of the 600 ms interval is compared to the threshold voltage; and if the voltage output thereby is higher than the threshold voltage, then supply of toner is carried out during the next 600 ms interval, control being carried out so as to maintain constant toner concentration.

If h grams of toner is supplied and output voltage changes from V1 to V2 when a toner supply drive member is driven for time t, this can be expressed as follows.

$$(V2-V1)=k\{(T+h)/-(T)/(C+T)\} \quad (1)$$

. . . where k=a constant; T=mass of toner within developer; C=mass of carrier within developer; h=mass of supplied toner.

Because the amount of toner which is supplied is much, much smaller than the mass of developer, it is possible to write (C+T)≅(C+T+h). Furthermore, because (C+T) is a known value, it is possible to write a=k/(C+T). This makes it possible to simplify the above formula as follows.

$$\Delta V=a\times h \quad (2)$$

$$\Delta V=(V2-V1) \quad (3)$$

That is, the change in output when a toner supply drive member is driven for time t can be expressed as a function of the amount supplied.

Toner Level Detection Operations

In an image forming apparatus associated with the present invention, supply of toner is carried out in correspondence to the aforementioned change in output, control being carried out so as to maintain constant toner concentration.

Figure 8:
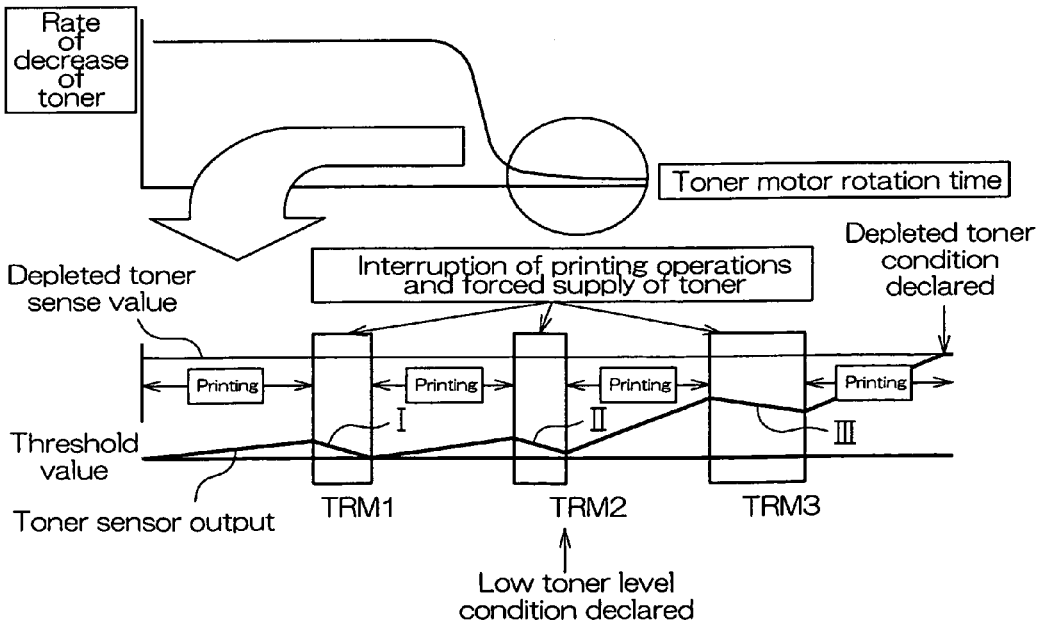
FIG. 8 is a timing chart to assist in explaining operations for determining existence of low toner level condition(s) in the present embodiment.

However, based on the relationship between the rate at which toner is delivered from toner hopper 45 and the rate at which toner is consumed, which depends upon print coverage and so forth, there may be situations in which toner supply is unable to keep up with toner consumption. In such case, because output from toner sensor 44 rises, where this state persists for one minute, control at the image forming apparatus is, as shown in FIG. 8, such that printing operations (image forming operations) are interrupted and forced supply of toner is executed (toner supply operations by forced supply execution means provided at a controller, not shown, are executed). Here, the fact that printing is interrupted means that only supply of toner takes place, there being no consumption thereof; so it is possible to ascertain the amount of change in toner concentration sensor output per unit time (ΔV/t) from the amount of change in toner concentration sensor output (ΔV) relative to the supply time (t).

Figure 7:
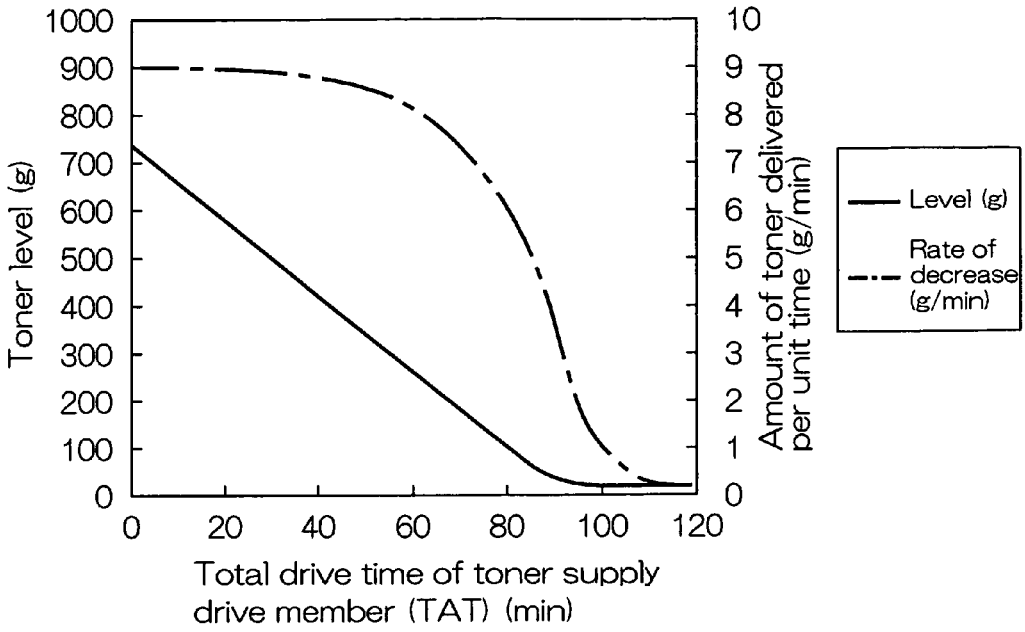
FIG. 7 is a drawing showing toner level and amount of toner delivered per unit time as functions of total drive time of a toner supply drive member at a toner hopper in the present embodiment.

As shown in FIG. 7, it can be seen that the rate at which toner is delivered from toner hopper 45 (the amount of toner delivered per unit time) gradually decreases as the toner level at toner hopper 45 falls. Furthermore, there is also variation with respect to infrequency of usage (where the apparatus goes unused for long periods of time), ambient conditions (temperature and humidity), and so forth. That is, in any of a number of situations it will be the case that toner supply cannot keep up, and printing operations will be interrupted and supply of toner will be carried out. However, as shown in FIG. 8, because the amount of change in toner concentration sensor output per unit time (ΔV/t; the slope of the toner sensor output curve at FIG. 8) when this forced supply of toner is being carried out can be related in one-to-one fashion to the toner level within toner hopper 45, by ascertaining this amount of change in toner concentration sensor output per unit time it is possible to detect the toner level within toner hopper 45.

In addition, the amount of change in toner concentration sensor output per unit time (ΔV/t) when there is an adequate amount of toner within toner hopper 45 is approximately 0.5 V/min to 0.6 V/min. That is, such a state is not determined to be a low toner level condition. However, with repeated consumption and supply of toner, based on the fact that ability to deliver toner is 0.855 g/min when toner supply cannot keep up with a print coverage of 6% such as in common use, −0.06 V/min, being the value obtained when this ability to deliver toner is converted into an amount of change in toner concentration sensor output (ΔV/t), is employed as criterion for determining existence of a low toner level condition, it being determined that a low toner level condition exists when the absolute value of the amount of change is less than this (0.06 V/min). In the situation shown in FIG. 8, a low toner level condition is not determined to exist when toner supply operation TRM1 is being carried out because the absolute value of the amount of change in toner concentration sensor output is greater than or equal to 0.06 V/min (the angle of inclination of line I in the drawing is relatively large); but a low toner level condition is determined to exist ("low toner level condition declared" in the drawing) when toner supply operation TRM2 or TRM3 is being carried out because the absolute value of the amount of change in toner concentration sensor output is below 0.06 V/min (the angles of inclination of lines II and III in the drawing are relatively small).

When a low toner level condition is thus determined to exist, "low toner level" is displayed at a display panel of the image forming apparatus, reporting to the user that the time to replace toner hopper 45 or the time to fill same with toner is approaching (what is referred to in the context of the present invention as reporting operations carried out by report means). Note that such reporting operations may be carried out by audible means.

Following determination of existence of a low toner level condition in such fashion, establishment that a depleted toner condition has been detected might be taken to occur, for example, at the point in time when the threshold voltage established for initially adjusted developer (unused) is exceeded by 0.3 V, at which time printing operations would be interrupted. In the situation shown in FIG. 8, following determination of existence of a low toner level condition during toner supply operation TRM3, a depleted toner condition would be determined to exist ("depleted toner condition declared" in the drawing) at the point in time when the voltage output by toner sensor 44 exceeds the threshold voltage by 0.3 V or more, and this fact would be displayed at a display panel of the image forming apparatus. Here as well, the depleted toner condition may be reported to the user by audible means.

As described above, whereas determination of existence of a low toner level condition is carried out based on whether the absolute value of the amount of change per unit time in the value output by toner sensor 44 is less than or equal to a low toner level sense value (the foregoing 0.06 V/min), determination of existence of a depleted toner condition is carried out based on whether the value output by toner sensor 44 exceeds a depleted toner sense value (the foregoing 0.3 V more than the threshold voltage).

Note that as a result of testing using a toner hopper 45 filled with 750 g of toner, this being the amount thereof when still unused, in the foregoing low toner level condition detection/reporting system, it was possible following reporting of the low toner level condition to print approximately 300 sheets until occurrence of the depleted toner condition.

Two more strategies for improving reliability of the aforementioned toner level detection operation(s) will next be described.

Considering the time a user would have to wait, forced supply of toner while printing is interrupted when supply of toner from toner hopper 45 cannot keep up should take a maximum of two minutes. Now, in the event that a prescribed toner concentration is not attained within developer storage container 43 despite passage of two minutes when it is the first time that toner is being supplied in forced fashion, a low toner level condition is determined to exist regardless of the amount of change per unit time in the output from the toner sensor ($\Delta V/t$). By so doing, it will be possible, even in the event of an insufficiency, to carry out printing of on the order of roughly 50 sheets from occurrence of the low toner level condition until occurrence of the depleted toner condition.

The other is to protect against the possibility of a problem with supply of toner from toner hopper 45. As shown in FIGS. 7 and 8, toner hopper 45 is initially filled with 750 g of toner, roughly 100 minutes of toner supply operations being required to deliver all of this toner therefrom. Therefore, even where determination might otherwise have been made that a low toner level condition exists, it is possible to determine that this must be due to some abnormality if the total cumulative time spent in performing toner supply is too low. Total cumulative time spent delivering toner is therefore stored at toner delivery time storage member 48 provided at toner hopper 45; and in the event that this time is under, for example, 80 minutes (what is referred to in the context of the present invention as the low toner level sense time), a low toner level condition is not determined to exist but an error is reported (by displaying same at a display panel and/or by audible report) even where conditions for declaring a low toner level condition would otherwise be satisfied (e.g., even where the absolute value of the amount of change per unit time in the value output by toner sensor 44 is less than or equal to the low toner level sense value). This makes it possible to let the user know when there is a problem that needs to be corrected at toner hopper 45, toner delivery member 47, control device(s) in connection with either of both of these, and/or the like.

OTHER EMBODIMENTS

Through the vehicle of the embodiment described above, application of the present invention to an image forming apparatus employing two-component developer comprising toner and carrier has been described. But the invention is not limited thereto, it also being possible to apply the invention to image forming apparatuses employing, as developer, one-component developer comprising only toner. In such case, toner quantity sensor(s) which detect amount(s) of toner(s) stored within developer storage container(s) 43 may be employed as toner detection means.

Furthermore, whereas the foregoing embodiment was described in terms of an example in which, when image forming operations are underway, those operations are interrupted and forced toner supply operations are executed; in the event of input of an image formation request signal (i.e., in the event that a print job is generated) while such forced toner supply operations are underway, the requested image forming operation(s) would be prohibited, such state being entered so that forced toner supply operations can continue.

Moreover, the present invention may be embodied in a wide variety of forms other than those presented herein without departing from the spirit or essential characteristics thereof. The foregoing embodiments, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. A method for detecting a toner level of a toner supply means in an image forming apparatus which provides a supply of toner from the toner supply means to a developer storage container, and which executes an operation in which toner is supplied from the toner supply means to the developer storage container when an amount of toner within the developer storage container detected by a toner detection means is less than or equal to a prescribed amount, the method comprising:

executing the operation in which toner is supplied from the toner supply means to the developer storage container while an image forming operation is interrupted and/or prohibited, and during execution of the operation in which toner is supplied from the toner supply means to the developer storage container, detecting a low toner level condition indicating that the toner level of the toner supply means is low by way of an absolute value of an amount of change per unit time in the amount of the toner within the developer storage container being detected by the toner detection means as less than or equal to a prescribed low toner level sense value, and reporting the low toner level condition to a user.

2. A toner level detection method according to claim 1 further comprising:

when executing the operation in which toner is supplied from the toner supply means to the developer storage container while the image forming operation is interrupted and/or prohibited, the amount of the toner within the developer storage container detected by the toner detection means fails to reach the prescribed amount despite execution of the toner supply operation, determining that a low toner level condition exists and reporting the low toner level condition to the user regardless of the amount of change per unit time in the amount of the toner within the developer storage container.

3. A toner level detection method according to claim 1 further comprising:

storing a cumulative time during which the operation in which toner is supplied from the toner supply means to the developer storage container is executed; and before a stored cumulative toner supply operation execution time reaches a prescribed low toner level sense time which is a time during which a low toner level condition can occur, the absolute value of the amount of change per unit time in the amount of the toner within the developer storage container detected by the toner detection means is less than or equal to the prescribed low toner level sense value, not carrying out low toner level condition reporting but reporting the fact that toner delivery is abnormal to the user.

4. A toner level detection method according to claim 2 further comprising:

storing a cumulative time during which the operation in which toner is supplied from the toner supply means to the developer storage container is executed; and before the stored cumulative toner supply operation execution time reaches a prescribed low toner level sense time which is a time during which a low toner level condition can occur, the absolute value of the amount of change per unit time in the amount of the toner within the developer storage container detected by the toner detection means is less than or equal to the prescribed low toner level sense value, not carrying out low toner level condition reporting but reporting the fact that toner delivery is abnormal to the user.

5. A toner level detection method according to claim 1 further comprising:

following detection of existence of a low toner level condition, it is detected by of the toner detection means that the amount of the toner within the developer storage container is less than or equal to a prescribed depleted toner sense amount, detecting the existence of a depleted toner condition indicating that there is no more toner within the toner supply means, and reporting the depleted toner condition to the user.

6. A toner level detection method according to claim 2 further comprising:

following detection of the existence of a low toner level condition, it is detected by the toner detection means that the amount of the toner within the developer storage container is less than or equal to a prescribed depleted toner sense amount, detecting existence of a depleted toner condition indicating that there is no more toner within the toner supply means, and reporting the depleted toner condition to the user.

7. A toner level detection method according to claim 3 further comprising:

following detection of the existence of a low toner level condition, it is detected by the toner detection means that the amount of the toner within the developer storage container is less than or equal to a prescribed depleted toner sense amount, detecting the existence of a depleted toner condition indicating that there is no more toner within the toner supply means, and reporting the depleted toner condition to the user.

8. A toner level detection method according to claim 4 further comprising:

following detection of the existence of a low toner level condition, it is detected by the toner detection means that the amount of the toner within the developer storage container is less than or equal to a prescribed depleted toner sense amount, detecting existence of a depleted toner condition indicating that there is no more toner within the toner supply means, and reporting the depleted toner condition to the user.

9. A toner level detection method according to claim 1 wherein:

a two-component developer comprising a toner and a carrier is stored within the developer storage container; and the toner detection means detects a concentration of the toner within the developer storage container.

10. A toner level detection method according to claim 2 wherein:

a two-component developer comprising a toner and a carrier is stored within the developer storage container; and the toner detection means detects a concentration of the toner within the developer storage container.

11. A toner level detection method according to claim 3 wherein:

a two-component developer comprising a toner and a carrier is stored within the developer storage container; and the toner detection means detects a concentration the toner within the developer storage container.

12. A toner level detection method according to claim 4 wherein:

a two-component developer comprising a toner and a carrier is stored within the developer storage container; and the toner detection means detects a concentration of the toner within the developer storage container.

13. A toner level detection method according to claim 5 wherein:

a two-component developer comprising a toner and a carrier is stored within the developer storage container; and the toner detection means detects a concentration of the toner within the developer storage container.

14. A toner level detection method according to claim 6 wherein:

a two-component developer comprising a toner and a carrier is stored within the developer storage container; and the toner detection means detects a concentration of the toner within the developer storage container.

15. A toner level detection method according to claim 7 wherein:

a two-component developer comprising a toner and a carrier is stored within the developer storage container; and the toner detection means detects a concentration of the toner within the developer storage container.

16. A toner level detection method according to claim 8 wherein:

a two-component developer comprising a toner and a carrier is stored within the developer storage container; and the toner detection means detects a concentration of the toner within the developer storage container.

17. An image forming apparatus employing the toner level detection method according to claim 1 to detect a toner level, the image forming apparatus comprising:

a forced supply execution means executing an operation in which toner is supplied from the toner supply means to the developer storage container while an image forming operation is interrupted and/or prohibited;

a toner detection means detecting an amount of change per unit time in the amount of toner within the developer storage container during execution of the toner supply operation by the forced supply execution means; and a report means that, when an absolute value of the amount of change per unit time in the amount of the toner within the developer storage container detected by the toner detection means is less than or equal to a prescribed low toner level sense value, detects existence of a low toner level condition indicating that the toner level of the toner supply means is low, and reports the low toner level condition to a user.

* * * * *